US008047589B1

(12) United States Patent
Trainor

(10) Patent No.: US 8,047,589 B1
(45) Date of Patent: Nov. 1, 2011

(54) APPARATUS FOR MAINTAINING FILTERED SWIMMING POOLS AND SPAS

(76) Inventor: Paul J. Trainor, Marshfield, MA (US)

( * ) Notice: Subject to any disclaimer, the term of this patent is extended or adjusted under 35 U.S.C. 154(b) by 232 days.

(21) Appl. No.: 12/460,120

(22) Filed: Jul. 13, 2009

Related U.S. Application Data

(60) Provisional application No. 61/134,759, filed on Jul. 14, 2008.

(51) Int. Cl.
*A47F 13/06* (2006.01)

(52) U.S. Cl. ..... 294/24; 294/26

(58) Field of Classification Search ..... 294/19.1, 294/24, 26; 15/1.7, 257.01; 210/167.19; 7/161; 73/864.52, 864.51, 864.634
See application file for complete search history.

(56) References Cited

U.S. PATENT DOCUMENTS

| | | | | |
|---|---|---|---|---|
| 4,176,419 | A * | 12/1979 | MacDonald | 15/1.7 |
| 5,137,623 | A * | 8/1992 | Wall et al. | 210/238 |
| D364,717 | S * | 11/1995 | Trapp | D32/42 |
| 5,487,397 | A * | 1/1996 | Bean | 134/6 |
| 5,553,905 | A * | 9/1996 | Bentivegna | 294/24 |
| 6,254,153 | B1 * | 7/2001 | Poppa | 294/19.1 |
| 6,425,614 | B1 * | 7/2002 | Limber et al. | 294/24 |
| 6,725,489 | B1 * | 4/2004 | Zell | 15/1.7 |
| 6,815,037 | B2 * | 11/2004 | Ooshima et al. | 428/113 |
| 7,014,231 | B1 * | 3/2006 | Callen | 294/24 |
| 7,309,088 | B2 * | 12/2007 | Fiore et al. | 294/24 |
| 2006/0179961 | A1 * | 8/2006 | Schaub et al. | 73/864.63 |
| 2008/0107146 | A1 * | 5/2008 | Hadj-Chikh | 374/1 |
| 2008/0146367 | A1 * | 6/2008 | Cruz | 473/286 |

FOREIGN PATENT DOCUMENTS

WO WO 9712242 A1 * 4/1997

* cited by examiner

*Primary Examiner* — Saul Rodriguez
*Assistant Examiner* — Stephen Vu
(74) *Attorney, Agent, or Firm* — Joseph E. Funk

(57) ABSTRACT

Apparatus is disclosed for performing tasks during maintaining filtered swimming pools and spas. The apparatus can perform a number of such maintenance tasks simultaneously, without having to kneel down, and comprises a number of individual tools for performing such tasks. The apparatus includes tools and elements for: (a) extracting skimmer covers, (b) lifting skimmer baskets, (c) grabbing a automatic cleaner hose, (d) snatching a pool thermometer line, (e) obtaining water samples, (f) confirming a depth of 18 inches to take a water sample, (g) securing a water chemical test strip for submersion into the water, (h) brushing the walls and sides of pools, (i) grasping and retaining a vacuum hose, (j) clenching and holding onto solid chemical tablets and sticks, and (k) removing leaves and debris.

4 Claims, 8 Drawing Sheets

APPARATUS FOR MAINTAINING FILTERED SWIMMING POOLS AND SPAS

RELATED APPLICATIONS

This application claims the benefit of U.S. Provisional Patent Application Ser. No. 61/134,759, filed Jul. 14, 2008, entitled "Maintenance System for Filtered Swimming Pools and Spas".

FIELD OF THE INVENTION

This invention relates generally to apparatus used to perform multiple routine swimming pool, lap pool, therapeutic pool, and spa maintenance tasks, often simultaneously, and from a standing or upright position. In particular, this invention conveys the extraction of skimmer covers, the removal of skimmer baskets, obtaining water samples, scrubbing the walls and vertical surfaces, taking the temperature of the water, removing debris from the water surface, re-positioning automatic cleaning devices, the submersion of water chemical test strips into the water, the gripping and placement of vacuum hoses over a filtration system water return to displace air with water, and the grasping of chemical tablets and sticks without physical contact.

BACKGROUND OF THE INVENTION

Swimming pools, lap pools, therapeutic pools, spas, and other self contained water and fluid reservoirs and holding basins require routine maintenance and cleaning. Routine maintenance consists of cleaning the filtration system skimmer(s), obtaining samples of water, recording the water temperature, brushing the pool walls, vacuuming the pool, and adding chemicals.

The primary swimming pool filtration system uses a pump or mechanical device to circulate the water by drawing the water into one or more in-takes, circulating the water through the filtering system, and then pumping the water back into the pool. To prevent large objects and debris from clogging the intake filter pipes and/or damaging the impeller of the filter pump, one or more water filter skimmer units is affixed to the side of the pool. The skimmer unit is located at or below the waterline and is comprised of a housing unit which collects water, a skimmer basket, and a removable cover to gain access to the skimmer basket. The skimmer cover is located outside the pool at or near ground level. The skimmer cover is designed to fit snuggly into a rabbit or notch on the top of the skimmer assembly to prevent people and animals from accidentally stepping into or falling into the skimmer assembly. Depending on the manufacturer's design, the skimmer cover will have one or two holes or slots which facilitates the cover to be removed. The diameter of the holes or slots varies by manufacturer. The skimmer cover is removed by bending or kneeling and sticking a finger into the hole and pulling the cover off. Once the skimmer cover is removed, the skimmer basket is revealed and accessible.

The skimmer basket is a submerged device used to trap waste and debris, such as leaves, bugs, rodents, paper, and other undesirable objects which may enter the pool. The skimmer basket is constructed in a grid like pattern, which, when not clogged by debris, is designed to allow water and small particles to flow to the pool filtration unit. The skimmer basket and skimmer assembly are designed so the basket will fit tightly into a cavity within the skimmer assembly unit and the basket will sit below the waterline. The clearance between the skimmer assembly cavity and the skimmer basket is tight to prevent debris from flowing between the skimmer assembly and the basket.

A lifting handle is located at the top of the skimmer basket. The handle is made of rigid plastic or metal and is intended to allow the pool owner or maintenance person to remove the basket from the skimmer assembly for cleaning. The standard method for removing the skimmer basket is for a person to bend, crouch or kneel down to lift and remove the skimmer cover, then place their hand into the water and grab the skimmer basket handle. This operation is uncomfortable for a healthy individual and difficult or impossible for anyone who has a disability or is not mobile enough to reach far enough to grasp the submerged skimmer basket handle. An even more objectionable and unhealthy aspect of the process is the fact the skimmer basket will have trapped debris, insects, vermin, and rodents, snakes, squirrels, rabbits, or other critters, which may be alive or dead. To grasp the skimmer handle a person must put their hand into the submerged skimmer basket which puts him in direct contact with the debris, insects, vermin, snakes or rodents trapped in the skimmer assembly. Once the skimmer basket has been removed, the debris is cleared from the basket, and the basket reinstalled into the skimmer assembly by bending over or kneeling and fitting the basket back into the skimmer assembly cavity. Likewise, the skimmer cover is placed back over the skimmer assembly.

The existing art for cleaning a pool skimmer is the manual procedure of bending, crouching or kneeling down, lifting the skimmer cover with a finger, and putting your hand into the skimmer unit and lifting the submerged skimmer basket. Alternative methods include lifting tools having limited functionality. Such lifting tools limited use do not perform maintenance functions, such as taking water, water depth indicator for taking water samples (18 inches), removing the thermometer, brushing the pool walls, vacuuming the pool, adding chemicals.

For sanitary and hygienic purposes, routine water testing is accomplished by taking samples and testing the chemical content, ph, algae and bacteria levels, as well as for other minerals and metals in the water. According to industry standards, water samples should be taken about one and one-half feet below the water surface. The recommended procedure is to fill the water sample container, pour the water out to rinse the container, and then re-fill the container. To obtain a water sample, the options have been limited to kneeling or lying down at the edge of the pool and with bottle in hand reaching one and one half feet down into the water, filling the container, rinsing the container, and re-filling it. An alternative method is to use what can best be described as a cup on a pole. The water can then be tested on-site using a manual water test kit or transported to a commercial facility where the sample can be tested using larger, more expensive and accurate, water testing equipment. The water sample container is typically a cylindrical cup, similar to a household measuring cup, with a large opening and without a cover. A better design is a bottle, attached to the pole by way of a removable clip or retainer, with a narrow or tapered mouth to prevent the water from being displaced before reaching the recommended depth of 18 inches and a leak proof cap to prevent spillage. The removable bottle clip also allows for the bottle to be positioned anywhere along the pole or completely removed from the pole.

Another maintenance problem is the removal of surface debris, particularly during windy days. The wind will often times blow debris such as leaves, grass clippings, flowers, twigs, and other matter into the pool. Until the debris becomes saturated by the water, it will remain floating on the surface.

Moreover, if the wind remains relatively constant from the same direction, the debris will accumulate in the leeward end of the pool. If this debris is not removed before it becomes saturated, it will either be drawn into the skimmer or eventually sink to the bottom of the pool.

To solve this common maintenance task, one option is to use the pool pole, which is generally long, 8 to 16 feet and therefore cumbersome, with a screen device attached to the end. Another option is to purchase a leaf and debris screen fitted to a shorter pole. The shorter pole is a single purpose device which does not perform any other pool maintenance task.

Vacuuming debris from the floor and walls of the pool is another routine maintenance requirement. To manually vacuum a pool a long hose is attached to a long pole with a vacuum head attached to the end. The other end of the hose is placed in a skimmer assembly over the skimmer basket. The suction of the pool filtration system will draw the water and debris through the hose and the large waster products will be trapped in the skimmer basket, while smaller particles will be passed through the filtration system. To displace the air in the vacuum hose, the most common method is to kneel or lie down at the edge of the pool and hold the hose against a pool filter water return. The water pressure from the return forces the air to be displaced with water.

An alternative methodology is the use of an automated pool cleaner. These devices are connected to the pool filtration system via a flexible hose or tube. The main component is a device that traverses the floor of the pool vacuuming as it moves along. One of the shortcomings of these devices is that its hose can get snared on other pieces of pool apparatus such as a swim ladder. To reposition the device, the user can manually push the unit with a long pole or kneel or lie down on the pool deck, put their hand in the water, grab the hose, and tug on it, causing the device to be dislodged from its trapped position.

In addition to vacuuming or cleaning the floor of the pool the sides or walls of the pool also require cleaning, in particular, the area of the pool between the waterline and the top of the pool, deck, coping or surface. These sections of the walls are prone to having a ring or line of dirt, pollen, sunscreen oil, and other film, at or just above the waterline. A brush is used to scrub the sides of the pool to remove the film. If the entire pool is shallow, an adult can walk around the pool and clean the area between the waterline and the water surface. This also assumes the water is warm enough for the person to be in the pool while cleaning. If the pool has a deep water end so a person cannot clean the walls and stand, then the person has to hold onto the pool side with one hand and clean with the other or be strong enough to swim and keep their arms above the water while at the same time clean the walls with one hand. Another option is to lie on the pool deck and reach into the pool to clean the area. This method requires the person to crawl around the entire deck on their hands and knees to clean all the walls.

The water temperature also plays a role in pool maintenance. Warmer water is a more conducive environment to the growth of bacteria, fungus, and other unsanitary organisms. A pool thermometer is tethered to a pool ladder or attachment ring located on the coping or deck with a length of string. To check the temperature, the user must kneel or lie down on the pool deck and lift the string and thermometer from the water to view the temperature reading. Existing art offers a hook to catch the thermometer, but does not include friction points along the hook to prevent the thermometer string from sliding off the hook.

To insure the pool water is sanitary and safe for use by humans and animals, a disinfecting agent such as chlorine must be added to the water. Many such chemical agents come in the form of solid tablets, sticks or cartridges. The solid forms have a dusty residue. If the user does not wash their hands immediately after handling these agents, the residual chemical dust will result in discomfort or injury if the contaminated hand comes in contact with eyes, mouth or any open skin sore or wound. The current solution for eliminating such contamination when retrieving these agents from their container is for the user to wear gloves. A better solution is not to physically touch the chemical agents, but rather grasp the solid agent with a device as set forth in the invention.

SUMMARY OF THE INVENTION

The invention provides new and utilitarian apparatus having advantages over the existing prior art and modalities for maintaining and servicing pools. Various modifications to the preferred embodiment will be readily apparent to those skilled in the art and the general principles used herein may be applied to other embodiments without deviating from the spirit and scope of the invention. As such, the invention is not intended to be limited to the embodiment described herein, but rather, is to be accorded the widest scope consistent with the principles and features disclosed herein.

The invention resides not in any one of the individual elements and features of a novel pool maintenance device disclosed herein per se, but rather in the particular combination of all of them and their interaction with respect to each other as disclosed and claimed herein. Those skilled in the art will appreciate that the novel concept upon which this disclosure is based upon may readily be utilized as a basis for the designing of other devices and pool maintenance methodologies for carrying out the several purposes of the present invention. Moreover, the abstract is neither intended to define the invention of the application, which is measured by the claims, nor is it intended to be limiting as to the scope of the invention in any way.

The core of this multi-function invention is a lightweight rigid pole ranging in length from thirty (30) inches to six (6) feet. One embodiment is a pole of fixed length with removable extension rods, ranging from twelve (12) to twenty-four (24) inches in length. This invention allows extensions to be connected by screwing the extension to the pole with male and female threaded fitting, using quick release button connector, a twist and lock style connector or other form of connector. The advantage of this embodiment is that the overall length of the pole can be extended by incremental lengths to accommodate short and tall body heights and allow for extended range and reach depending on the specific application for which the device is being employed. An alternative embodiment is an adjustable lightweight rigid pole that can be extended. The adjustable embodiment would incorporate a locking or tightening mechanism that could be loosened or tightened to extend or shorten the overall length of the adjustable pole. Regardless of the embodiment, the pole and each attachment is constructed of a durable material, such as plastic or metal, that is intended to be used and stored outside and includes protection against decomposition caused by ultraviolet (UV) light and caustic chemicals such a chlorine.

At the apex of the pole is an ergonomic non-slip grip to allow the user to firmly hold on to the pole and provide comfort. The grip, made of foam or plastic, is affixed to the pole and is constructed of a material for outside use with protection from ultraviolet light.

In part, the invention is unique because the pole is designed to allow for the attachment of the different tools and other apparatus necessary to perform all standard pool maintenance to one end of the pole, the working end of the pole, and attach devices to the side of the pole using a removable clip. It is not necessary for the user to flip, rotate or turn the pole end over end to perform any task. A multi-function attachment, consisting of a skimmer cover extracting tab, can be connected to the end of the pole which will remove the skimmer cover, lift the skimmer basket, and hook the line connected to the thermometer. This attachment consists of a tapered extracting tab which is inserted in skimmer cover lifting holes or slots, regardless of shape or diameter. At the base of this attachment is a horizontal extracting tab, with a flat horizontal surface, at a 90 degree angle to the pole. When moved in any direction perpendicular to vertical and lifted, the tab will catch the skimmer cover and remove it. A "v" shaped extractor, perpendicular to the pole, is positioned about 3 inches above the skimmer cover lifting tab. When used to extract a skimmer basket handle, grab onto a thermometer line or grab onto a automatic cleaner hose, the "v" shape design results in the item being lifted becoming wedged and therefore not slipping off the extraction hook. Moreover, at the top of the "v" extraction hook, which is its widest point, is an inward flange which further prevents objects that are lifted or seized with the hook from slipping or falling off. The "v" shaped extraction hook serves multiple functions. When the attachment is inserted into the skimmer cover slot or hole, the "v" hook limits the amount of vertical travel the skimmer cover lifting tab can be inserted into the skimmer cover slot or hole. Additionally, the extracting hook functions as the mechanism to catch and extract the skimmer basket. A novel and functional aspect of the extraction hook is the friction points molded on the interior surface of the hook, which further prevent the item being lifted from slipping or sliding off the hook. The interior surface friction points are embodied by horizontal, vertical and/or crosshatched convex and/or concave serrations, a series of protuberances or a combination thereof. The friction points on the hook prevent the skimmer basket from falling off the tool, allows the hook to catch the line attached to the thermometer and thereby allowing the user to raise the thermometer, and allows the user to clinch the submerged hose of an automatic pool cleaning device.

Those skilled in the art understand that automatic cleaners are intended to traverse the entire pool, but from time-to-time get stuck in a corner of the pool or the hose connected to the cleaner can get snared on a pool ladder or other apparatus. The cleaner is freed by pulling on the hose which requires lying on the ground, reaching into the water, and giving a tug on the hose. Because of its taped shape and friction points, the hook described in this invention easily clasps the hose and allows the user to pull the cleaner hose, thus displacing the device and allowing it to continue to navigate the pool. As with all of the other functions performed with this invention, all tasks are completed while standing. No kneeling, crouching or lying down on the ground is required. Furthermore, at no time does the user put their hand into the skimmer basket nor does s/he come in contact with the debris, insects, rodents and/or other waste captured in the skimmer basket.

Another innovative and useful feature of the multi-function lifting tab and hook attachment, as well as the other attachments, is the protruding band or lip around the circumference at the top of the attachment, where it connects with the pole, which serves as a stop to prevent devices and tools attached to the body of the pole from sliding off. The water sampling bottle and other side mounted tools are attached to the body of the pole, just above the multi-function lifting tab and hook attachment. Because the top of the attachment is larger in diameter than the outside diameter of the pole, the retaining clip, which holds the water bottle and other vertically attached devices to the pole, cannot slide off the pole, even if the bottle is filled with water or the retaining clip loses its tension or holding strength.

The invention also includes vertically mounted tools and devices attached to the body of the pole using a double ended retaining clip. For added versatility, the retaining clip is a separate component with one end of the clip being attached to tool and the other end of the clip connected to the body of the pole. The retaining clip can be physically removed from both the pole and the device or tool. The water sample bottle can be clipped to the body of the pole, lowered into the pool to the prescribed depth of eighteen (18), and then the retention clip and bottle can be removed from the pole. With its removable leak-proof cap, the water sample bottle can be sealed and safely transported to a water testing facility or tested at the user's location. An unexpected result and benefit of the retaining clip is that a water chemical test strip can be placed between the pole and the clip and the clip tension will hold the test strip in place. Chemical test strips allow the user to test the pool water's chlorine, balance, calcium, and other agents by swirling a small chemically treated strip in the water. The current methods of using a test strip is either bending or lying down and, while holding a strip, insert your arm into to water and swirl or stir the strip. Alternatively, a sample of the water can be taken and the user then swirls the strip in the water container. With this invention the user can insert a test strip between the retaining clip and the pole and the tension of the clip holds the strip in place while the user stirs the pole in the water at the correct depth of eighteen (18) inches. And, the user can accomplish this without bending, kneeling, lying down or sticking their arm into the water.

Another innovative feature of the invention is the conspicuous water sample depth marker on the pole or in an alternative embodiment on a label attached to the pole which clearly shows the user when the water sample bottle has been lowered to a depth of eighteen (18) inches into the water. The integrated depth marker on the pole eliminates having to guess when the bottle has been submerged eighteen (18) inches or the need to use a separate measuring instrument to determine when the water bottle has been lowered to the correct depth.

As an alternative to a water thermometer attached to a line and tied to a pool ladder or pad eye and submerge the thermometer in the water, with this invention a thermometer can be connected to the pole using a removable retaining clip. With this embodiment, the thermometer does not need to remain indefinitely submerged in the pool, but rather can be inserted into the water, from an upright stance, on an as needed basis. Once the pool water temperature is determined, the thermometer can easily be removed from the pole and safely stored away. This novel solution does not require the user to enter the pool, or bend, kneel or lie on the deck and insert their arm into the water.

The invention also allows for a leaf and debris screen to be attached to the end of the pole. As with the other attachment that can be connected to the working end of the pole, the top of the screen attachment, where it connects to the pole, is larger in diameter than the outside diameter of the pole, thereby preventing any attachment connected to the side of the pole from sliding off. An advantage of this invention over prior art is that multiple attachments simultaneously be connected to the same pole, eliminating the need to purchase numerous single purpose tools or acquiring several tools which perform some, but not all, routine maintenance tasks. Standard pool poles are typically made of metal, often aluminum, eight (8) feet long and can be extended to twelve (12) or more feet, have an outside diameter of one (1) inch or more, and are thus heavy and difficult to maneuver. This invention is lightweight, can be equipped with multiple tools connected at the same time, and can be lengthened to the individual user's desired length by adding extensions.

To clean pool side walls, in particular the space between the waterline and the deck or coping, a brush can be attached to the working end of the pole. The preferred embodiment has an adjustable brush head device which includes an "L" shaped elbow. The "L" shaped elbow design results in the brush being perpendicular to the pole, but slightly off-set. Because the pool deck or coping often extends over the pool walls the angle adjustment and the "L" shaped configuration allows the user to scrub the pool walls while standing and without bending or twisting their torso. The shape of brush may be embodied in a number of forms including round, square, rectangular or oval. Once the brush is attached to the pole, the user can either stand on the deck and brush the walls or alternatively brush the walls from inside the pool. Those skilled in the art understand that the only alternatives to clean the walls of the pool are kneeling or lying on the deck and holding a brush in their hand, reaching into the pool and scrubbing that section of the wall that can be reached, then, re-positioning themselves and doing another section of wall. The other option is using an ordinary brush attached to a pole which was designed for another purpose other than cleaning pool walls. Such devices lack the "L" shaped elbow design and adjustable head to accommodate the overhanging deck or coping.

Other components of the invention include a gripping attachment. This device is connected to the end of the working end of the pole and the attachment grasps a standard pool vacuum hose or chlorine or chemical tablets and sticks. For pool vacuuming, the vacuum hose is held by the attachment. Then the pole is lowered into the water and the hose is held over a filter return or inlet. The pressure from the filter's return forces the air from the hose. Once all of the air is forced out of the hose with water, the pole is lifted and the entire device and hose are moved to the skimmer assembly where the hose is placed over a skimmer basket which creates the vacuuming action. The conventional method of removing the air from the hose is to lie on the deck and holding the hose in their hand the user sticks their arm into the water and holds the hose over the inlet until the air is displaced.

When used to pick-up chlorine tablets and sticks, the gripping attachment grabs a single tablet or stick from its container and allows the user to deposit the tablet or stick into the proper dispenser without having to touch the chemical agent and thus have to deal with the resultant chemical dust contaminates.

To easily store the invention including its various component elements, an eye hook or similar hanging device is integrated into the handle at the head of the pole. Some attachments by their very design, such as the skimmer cover and skimmer basket attachment can easily be stored by merely hanging the tool by its hook. Other attachments such as the brush include a hole in the connecting section so the attachment can be stored on a pin or dowel. An alternative embodiment is to include an eye hook, at the connecting end of the attachment for example, to allow for easy storage of the device.

While the description of the invention set forth herein is a preferred embodiment of the invention, it is understood that numerous changes may be made by those skilled in the art without departing from the spirit, scope, and purpose of the invention.

DESCRIPTION OF THE DRAWINGS

The invention is better understood upon reading the following Detailed Description in conjunction with the drawings in which:

FIG. 3 also shows the water depth indicator mark of 18 inches which is integrated onto the pole.

DETAILED DESCRIPTION

Figure 1:
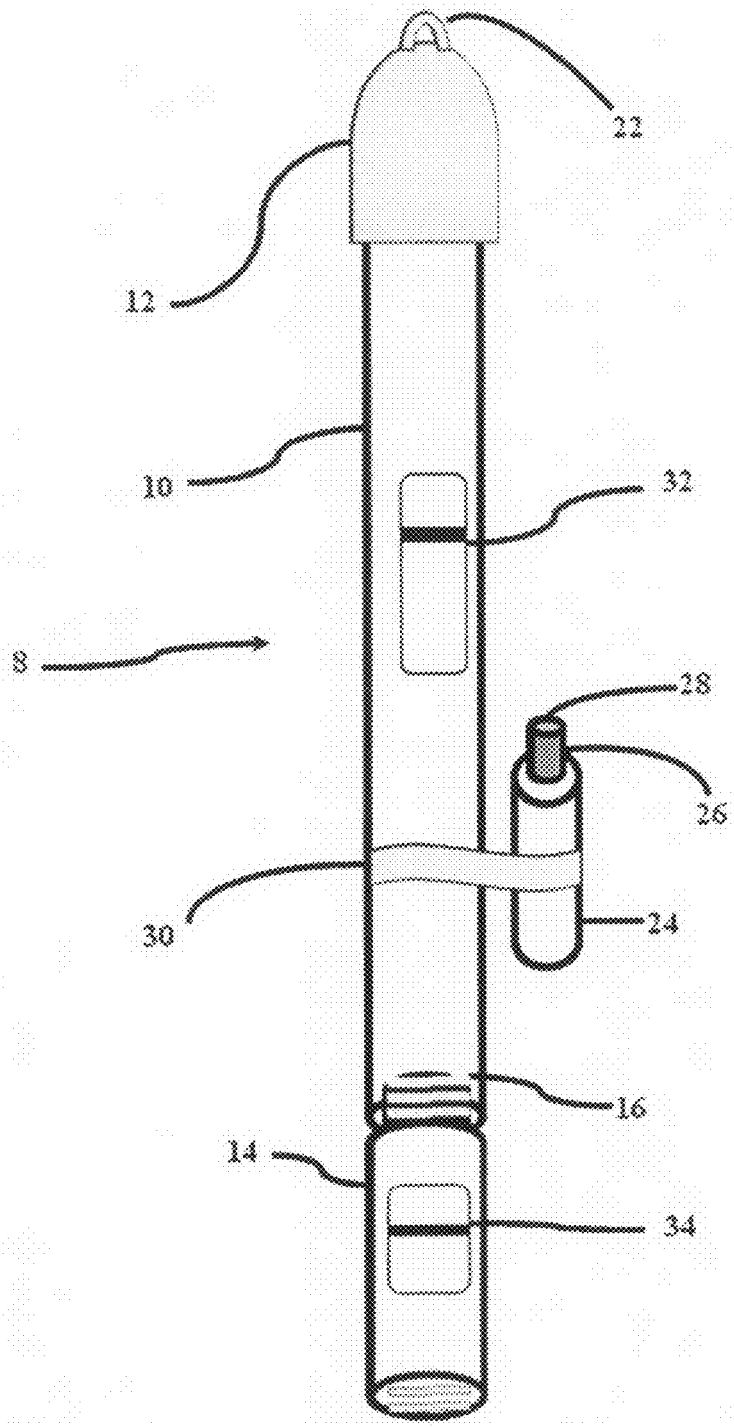
FIG. 1 is a representative depiction of the maintenance device platform, the pole, upon which each of the various attachments is connected.

| Drawing Reference Numbers | |
|---|---|
| 8 | pool maintenance device |
| 10 | device pole |
| 12 | handle grip |
| 14 | extension rod |
| 15 | skimmer cover and skimmer basket extractor attachment |
| 16 | extension rod connector |
| 17 | skimmer cover extracting tab |
| 19 | extractor hook |
| 21 | extractor friction points |
| 22 | pole hanger |
| 23 | inverted retaining hook element |
| 24 | removable water sample bottle |
| 25 | protruding band or lip |
| 26 | tapered water sample bottle neck |
| 28 | leak proof bottle cap |
| 30 | removable retaining clip |
| 32 | pole 18 inch water depth indicator |
| 34 | extension rod 18 inch water depth indicator |
| 36 | water chemical test strip |
| 40 | removable water thermometer |
| 50 | removable gripping attachment |
| 60 | removable pool wall and side brush |
| 62 | brush elbow |
| 64 | brush swivel unit |
| 70 | removable leaf and debris screen |

The following description is to teach a person skilled in the art to make and use the invention. Various modifications to the preferred embodiment disclosed herein will be readily apparent to those skilled in the art, and the general principles defined herein may be applied to the other embodiments and applications without departing from the spirit and scope of the invention. Therefore, the present invention is not intended to be limited to the embodiment disclosed herein, but is to be accorded the widest scope consistent with the principles and features disclosed herein.

The need in the art for an easy to use multi-function pool maintenance device is satisfied by the present invention which provides a new and novel solution. This novel invention 8 uses a rigid pole 10, preferably made of plastic or a non-corrosive metal, as in the prior art, but also introduces ultraviolet light (UV) protection impregnated into the pole, an integrated water depth marker indicating a depth of 18 inches 32, extension rods to lengthen the pole 14 using connectors 16, and removable retaining clips 30 to attach multiple devices to the pole 10, such as a water sample bottle 24, water chemical test strips 36, and a thermometer 40.

More specifically, at the top of the pole 10 is a handle grip 12 which provides the user both comfort and a non-slip surface. As with the pole 10, the grip 12 also contains UV protection to prevent deterioration from harmful sun rays. For convenient storage, an eye or hook 22 is incorporated into the grip 12 allowing the device 8 to be mounted on a dowel or pin. The pole 10 is a fixed length. The preferred embodiment is for the pole 10 to be between 30 inches and 6 feet in length. The pole 10 may be lengthened in fixed increments by connecting 16 fixed length extensions 14. One or more extension rods 14 can be connected 16 to the pole 10 to accommodate individual physical needs and to adjust to the attachment being used. For example, to clean the pool walls may require multiple extensions 14 to allow for the brush attachment 60 to reach the proper depth.

At the bottom end of the pole 10 application specific attachments can be connected. Although the favored embodiment is that the end of the pole 10 allow for the connection of removable components using threaded fittings 16, spring or tension loaded pins or a similar type of quick release connector, an alternative embodiment is to permanently affix the skimmer cover and skimmer basket remover attachment 15 and connect the other maintenance devices with removable retaining clips 30.

Figure 2:
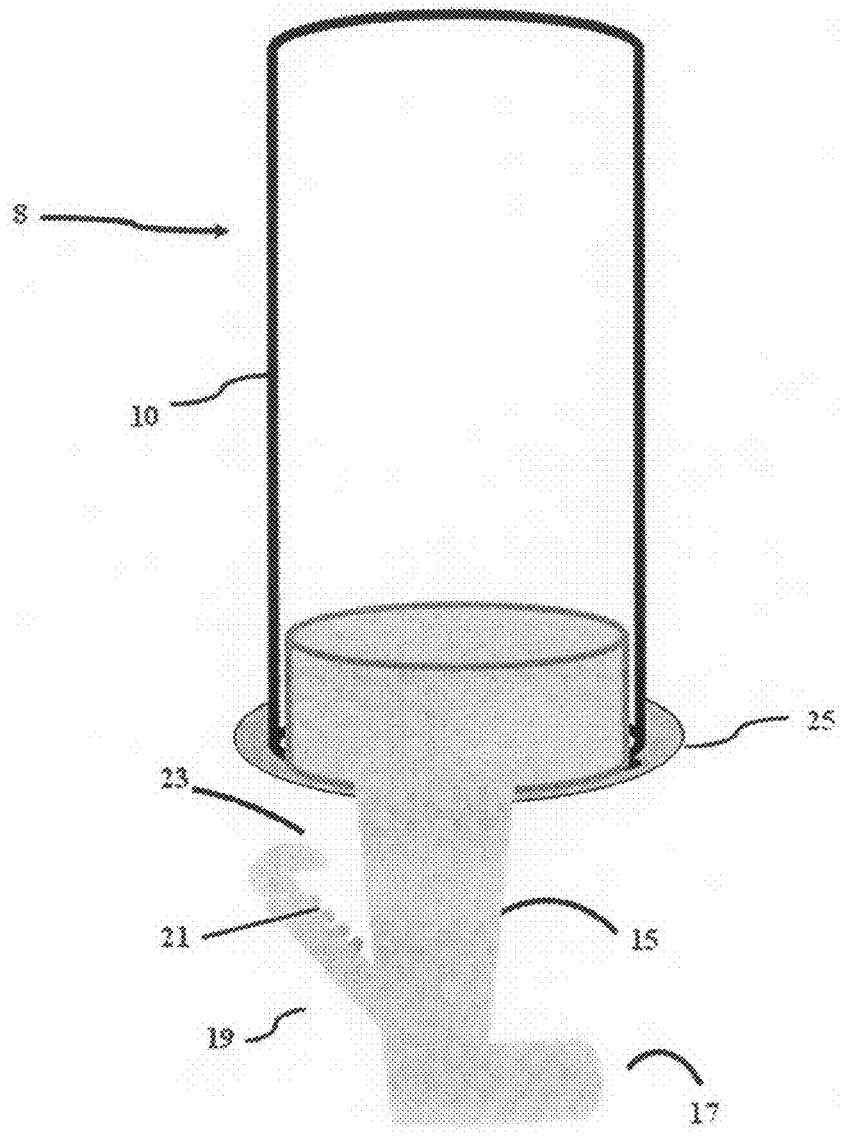
FIG. 2 is a cutaway side view of the novel skimmer cover remover and skimmer basket lifting attachment. The drawing also illustrates the protruding band or lip at the point of the attachment where it interconnects with the pole.

As illustrated in FIG. 2, the novel skimmer cover extracting tab and the skimmer basket extracting hook attachment 15 can fulfill several tasks. The skimmer cover extracting tab 17 is at a right angle to the pole 10. This insures that the tab 17 will fit through the skimmer cover hole or slot and permit the user to remove the cover by pulling straight up. The skimmer basket extracting hook 19, located on the opposing side of the lifting tab, serves as a stop so the skimmer cover extracting tab 17 cannot be inserted too deeply into the skimmer cover hole or slot. The main function of the skimmer basket extractor is to remove the skimmer basket by lifting the skimmer basket handle, which is located on the top of the skimmer basket. The skimmer basket extractor 19 provides additional novel features. To prevent the skimmer basket handle from sliding off the device, friction points 21, consisting of raised elements and/or serrations, are included on the interior surface of the hook 19. Additionally, an inverted hook or tab 23 is located at the top of lifting hook 19 to further retain the basket handle. The design of the lifting hook also allows the hook to be used to grab automatic cleaner hoses. If an automatic cleaner becomes trapped and does not traverse the pool, the lifting hook 19 can be used to catch and lift the submerged automatic cleaner hose. Once hooked, the automatic cleaner hose can be pulled using the lifting hook 19, thus causing the automatic cleaner to move and be redirected. The "V" shape design of the extracting hook 19 together with the friction points 21 forces the automatic cleaner hose to be wedged snuggly into the device providing the user excellent leverage and purchase power. Those skilled in the art will further appreciate the "V" shaped wedge design of the extracting hook 19 and its friction points 21 when the device is used to grab and lift the thin line or string attached to a submerged thermometer 40. The versatility of the "V" shaped designed extracting hook 19 is apparent by the fact it can grab onto automatic cleaner hoses which are typically about 1 inch in diameter, as well as small lines like those attached to a thermometer 40 which can be as small as one-quarter of an inch. As with the other devices and attachments associated with the invention, UV protection is incorporated into the skimmer cover and skimmer basket remover attachment 15.

The invention provides a novel alternative to hanging a thermometer from a length of string from a pool ladder or deck mounted pad-eye. Using the removable retaining clip 30 a thermometer 40 can be attached onto the body of the pole 10. From an upright position, the user of the invention can hold the grip 12 and insert the pole 10 together with a thermometer 40 connected to the pole 10 with a retaining clip 30 into the water to get the water temperature reading.

Another innovative aspect of the invention is the protruding band or lip 25 on each attachment at the point where the attachment is connected to the bottom of the pole 10. FIG. 2 offers an illustration of the protruding band or lip. At the point where the attachment abuts the bottom of the pole is an integrated overhanging band or lip 25 which is larger in diameter than the pole 10. The band or lip 25 acts as a ledge which prevents retention clips 30 from sliding off the end of the pole 10 even if the retention tension of the clip 30 is lessened due to expansion caused by heat or normal wear and tear.

Figure 3:
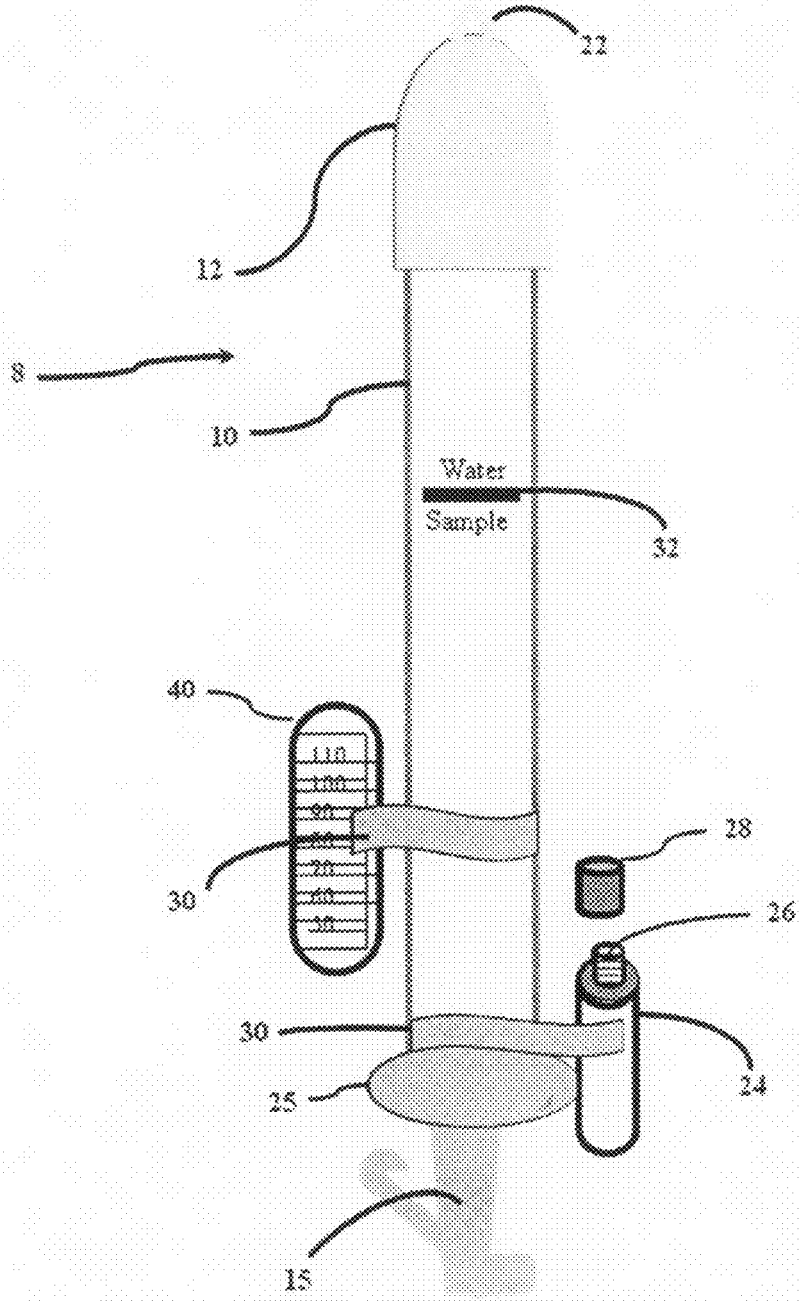
FIG. 3 shows how multiple attachments can simultaneously be connected to the pole using removable retaining clips.

To those who are skilled in the art, the invention's novel way to collect accurate water samples will be of great value. A tapered 26 water sample bottle 24 is attached to the bottom of the pole 10 using a removable retaining clip 30. If an attachment is connected to the pole 10, the retaining clip 30 can be placed just above and rest on the protruding band or lip 25. Holding the grip 12, the pole 10 is lowered into the water until it reaches the conspicuous 18 inch water depth indicator or mark 32 built into the pole 10. Because the water bottle 24 is tapered 26, water flows gradually into the bottle 24 as the air in the bottle 24 is slowly displaced by water while being lowered to its optimum depth of 18 inches. For ease of use, the 18 inch water depth indicator 32 is measured from the bottom of the pole 10, without an attachment connected as shown in FIG. 3. To solve the problem of determining a water depth of 18 inches when an extension rod 14 has been connected to the end of the pole 10 each extension rod 14 also includes its own conspicuous 18 inch water depth indicator 34. From the bottom of the extension rod 14 to the water depth marker 34 located on the extension rod 14 is a distance of 18 inches. The water bottle 24 and the retaining clip 30 can each be removed from the pole 10 and the bottle 24 can be sealed using the leak proof cap 28. The leak proof cap 28 allows the bottle 24 to be safely transported to a remote testing facility. FIG. 3 shows the relationship of the water sample bottle 24 to the water depth indicator as well as the tapered mouth of the bottle 26 and the bottle cap 28.

Figure 6:
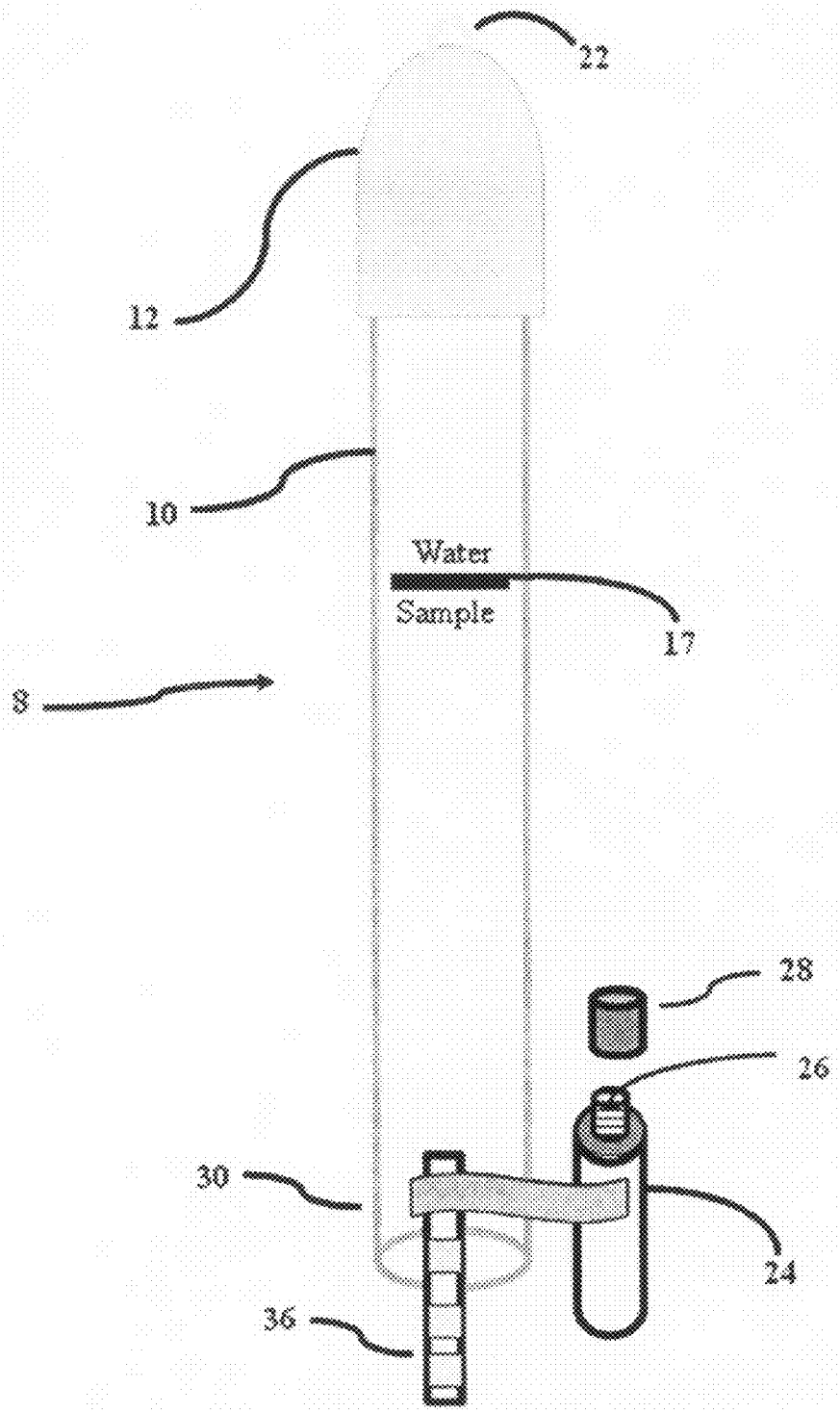
FIG. 6 illustrates how a water sample bottle can be clipped to the pole and at the same time a pool water chemical test strip can be held by the same retaining clip.

Those trained in the art understand that water samples are taken to test the water. An alternative method of testing the water is to use specially treated chemical strips 36. Water test strips 36 are activated either by sticking your arm into the water and swirling the strip or by swirling the strip into a filled water sample bottle 24. The invention provides a novel way to test pool water using chemical strips 36. In FIG. 6, the chemical strip 36 can be placed under a retaining clip 30 and attached to the bottom of the pole 10. The pressure of the retaining clip 30 against the pole 10 holds the chemical strip 36 in place. With the chemical strip 36 held in place under the retaining clip 30 at the bottom of the pole 10, holding the handle 12, the pole 10 is lowered into the water to a depth of 18 inches as determined by the water depth indicator 17 built into the pole 10. The pole 10 is swirled in a circle, as recommended by the manufacturer of the chemical strip 36, which actives the chemical agents on the strip. The pole 10 is then pulled from the water, the chemical strip 36 is removed from the retaining clip 30, and the test results can be observed and evaluated.

Figure 4:
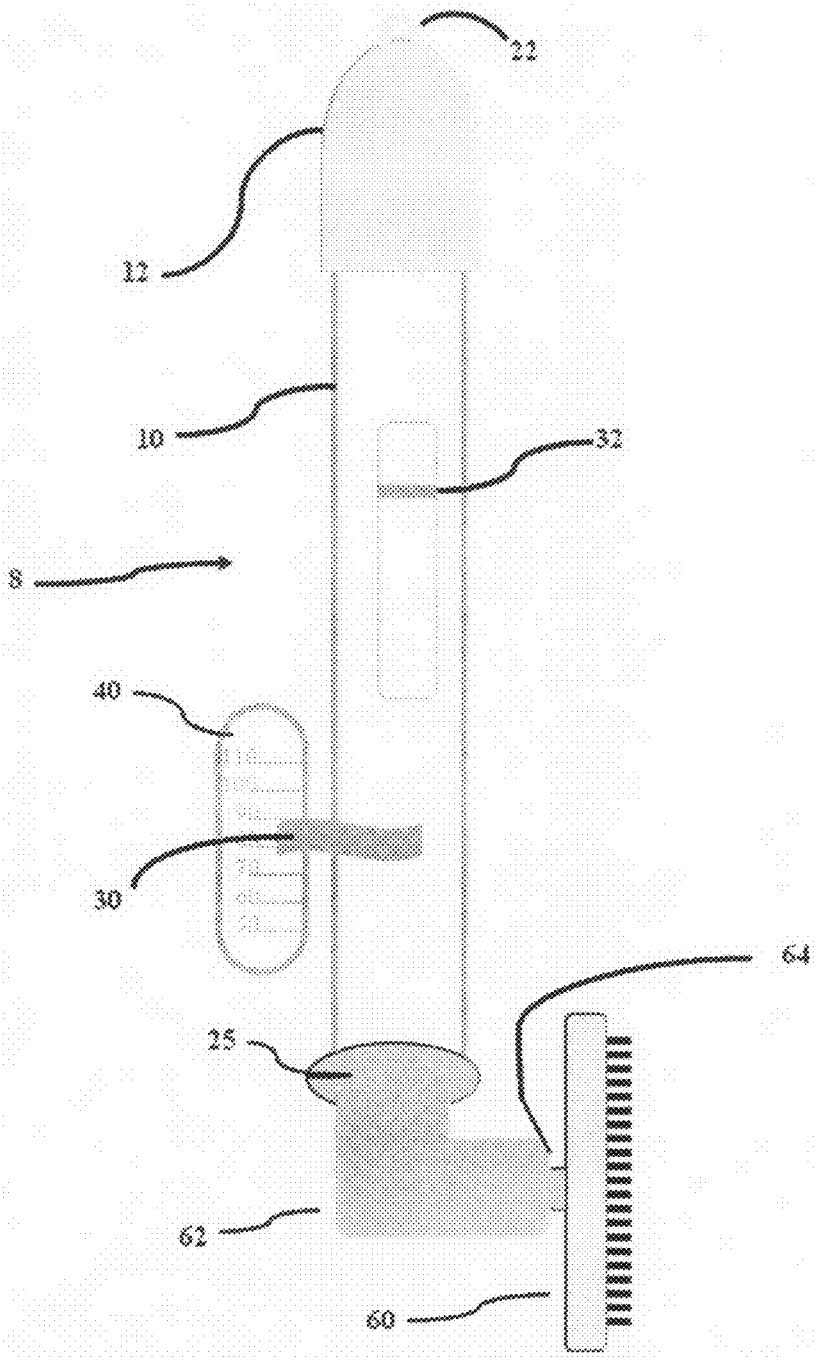
FIG. 4 is an illustration of the brush attachment which when connected to the pole is parallel to the walls or sides of the pool and to the pole. The swiveling feature of the brush is also shown.
Figure 8:
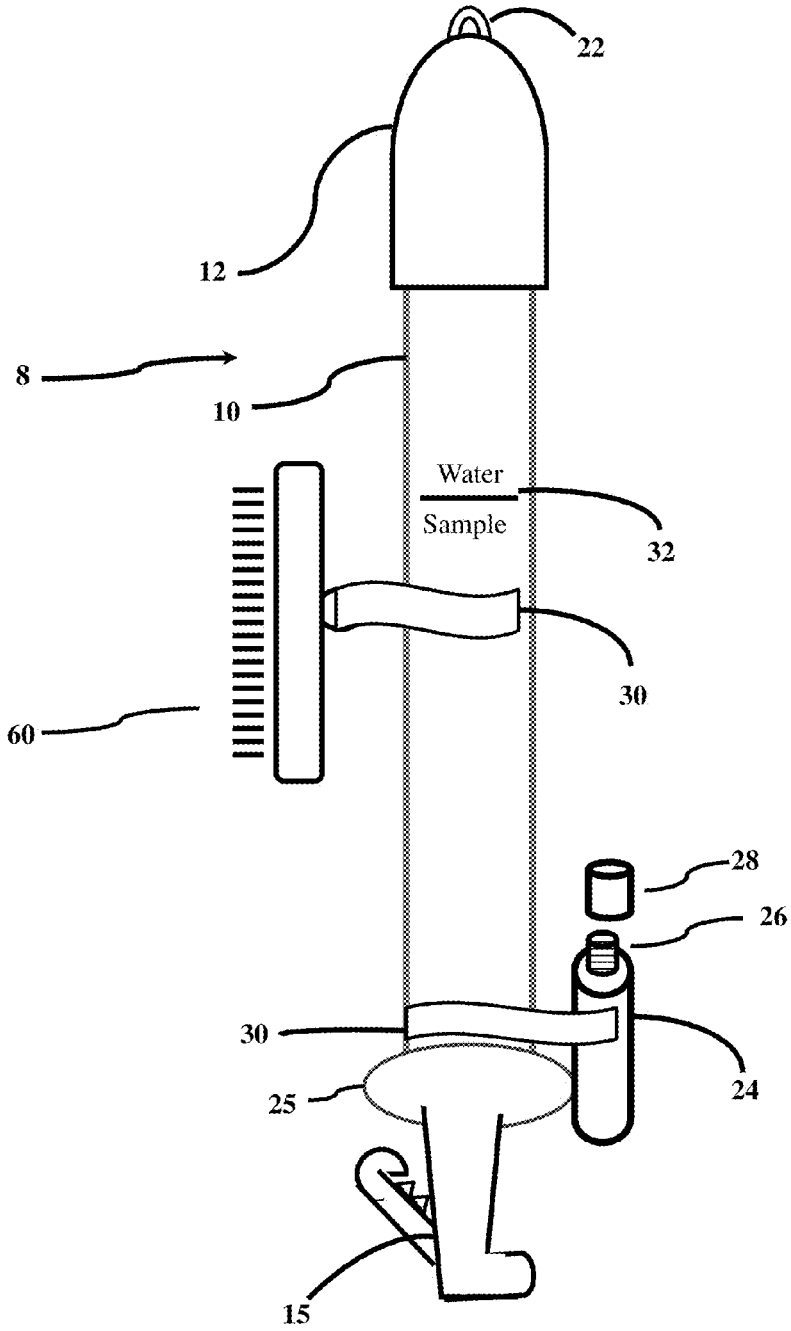
FIG. 8 shows a brush attached to the side of a pole using a retaining clip.

The invention also includes a brush 60 to clean the pool walls and sides. The preferred embodiment is that the brush 60 be connected to the bottom of the pole 10 using a threaded (male/female) fitting, twist and lock connector or a quick release button or pin connection 16. An alternative configuration would be to attach the brush 60 to the pole 10 using a retaining clip 30 as shown in FIG. 8. In either embodiment, the brush 60 is parallel with the pole. As depicted in FIG. 4, the brush 60 would include an elbow or right angle 62 so the brush would offset a few inches from the pole 10. This offset and right angle 62 would allow the brush to make contact with the pool walls and sides even if the pool has an overhanging deck or coping. The brush 60 is connected to the right angle component 62 using a swivel joint 64 which could lock the brush 60 in a fixed position when used to clean straight vertical walls or allowed to swivel when used to clean sides that slope.

Figure 5:
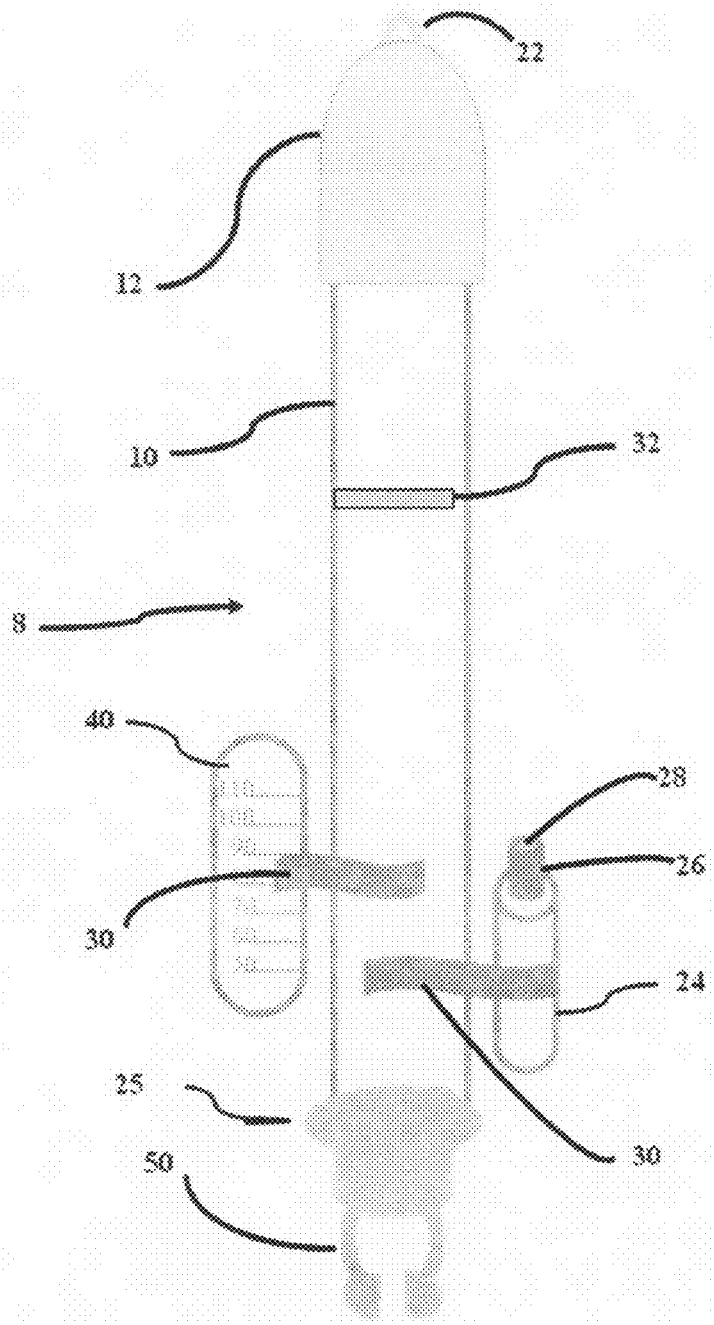
FIG. 5 is a view of the gripping attachment used to pick-up chlorine and chemical tables and sticks as well as grasping the pool vacuum hose.

To grab large items such a pool vacuum hoses and chemical tablets and chemical sticks the gripping attachment 50 is added to the end of the pole 10 as shown in FIG. 5. The preferred embodiment is to connect the gripping attachment 50 to the end of the pole 10 using a threaded (male/female) fitting, twist and lock connector or a quick release button or pin connection 16. Those skilled in the art understand that prior to connecting the pool vacuum hose to the filtration system, the air must be removed from the hose and replaced with water. Otherwise, the filter pump may lose its prime and/or the pump can be damaged due to a lack of water. To displace the air in the hose with water, the common practice is to lie on the deck and hold the hose over a water filtration return line, which is located below the waterline, until the air is removed. The invention includes the novel concept of grabbing the vacuum hose with a gripping attachment 50 connected to the end of the pole 10. The gripping attachment 50 consists of two opposing spring fingers. When the gripping attachment 50 is pressed against the hose, the hose slides through the open end and the pressure and tension of the opposing fingers retain the hose. Once the hose is grabbed, the pole 10 is lifted using the handle 12 and the end of the hose lowered into the water and placed in front of a water return line. The water pressure from the return line forces the air from the hose. When all or most of the air is removed, the pole 10 is lifted from the water and the vacuum hose is placed over the skimmer basket. Of course the skimmer cover is removed using the skimmer cover and skimmer basket lifting attachment 15. Another use of the gripping attachment 50 is to pick up chemical tablets and sticks. Many pool chemicals are available in solid form in the shape of a tablet or stick. Those with knowledge of the art know that the tablets and sticks are dusty and leave a chemical residue on a person's hands. Using the gripping attaching 50, a tablet or stick can be picked up from its container without ever physically being touched. Hold the handle 12 of the pole 10 with the gripped attachment 50 connected to the other end. Then the gripper fingers are pressed against a chemical tablet or stick and the pressure of the gripper fingers holds the tablet or stick in place. The tablet or stick is removed from the gripper fingers by simply pushing or lightly tapping the tablet or stick against the side or bottom of device receiving the tablet or stick.

Another key concept of this novel invention which those experienced in the art will have appreciation for is the fact that several pool maintenance tasks can be accomplished simultaneously. As pictured in FIG. 3, the invention 8 has the capacity to be configured with numerous attachments. As depicted in FIG. 3, the invention 8 can remove the skimmer cover and the skimmer basket with the skimmer cover and skimmer basket lifting attachment 15. The pole 10 can then be lowered into the water to a predetermined depth of 18 inches 32 and a sample of the water can be retrieved using the water sample bottle 24. Concurrently with the water sample being taken, the water temperature is established with the thermometer 40 which is also attached to the pole 10 using a separate retaining clip 30. At the same time the water sample is being taken and the water temperature is being determined, a water chemical test strip 36 could also be secured between either of the retaining clips 30 or by a separate retaining clip 30 and the pole 10 and be used to analyze the water. Moreover, at the conclusion of these simultaneous operations, the water sample bottle 24 can be detached from the removable retaining clip 30, sealed with the leak proof cap, and securely transported to a water testing facility. All pool maintenance performed with the invention 8 are accomplished while standing upright. The inconvenience and discomfort of kneeling, crouching or lying down to do routine maintenance is eliminated. The invention 8 also does away with the maintenance activities that required sticking your arm into the water or worse having to reach into a debris filled skimmer basket to remove it.

Figure 7:
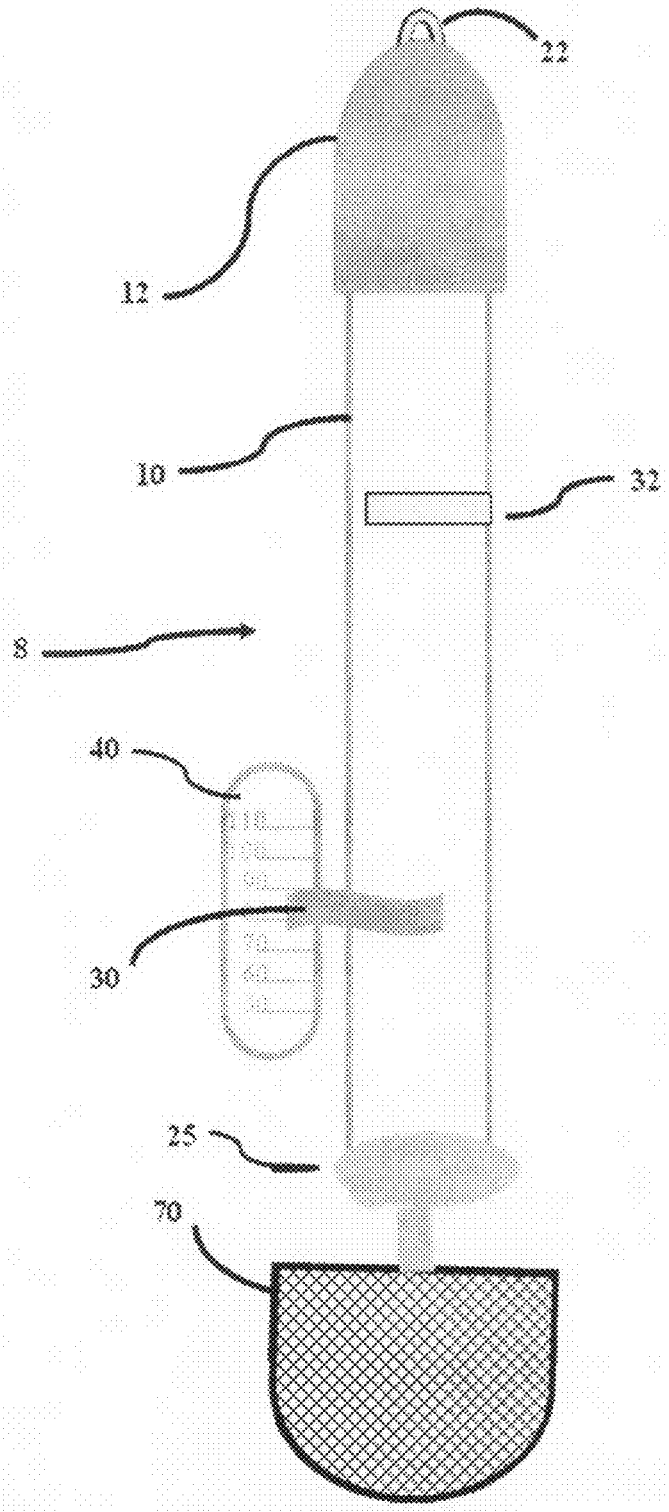
FIG. 7 shows a leaf and debris screen attachment on the bottom end of the pole.

As illustrated in FIG. 7, the invention also allows for a leaf and debris net or screen 70 to be connected to the end of the pole 10 using a threaded (male/female) fitting, twist and lock connector or a quick release button or pin connection 16. As with the other invention attachments, a protruding ring 25 is incorporated into the design at the point where the screen 70 makes contact with the pole 10, which prevents other vertically mounted attachments from sliding off of the pole 10. Those skilled in the art know that the current method for removing floating leaves and debris involves the use of a screen attached to a heavy and cumbersome long pole, usually a heavy metal vacuum pole. The shear length and weight of these longer poles cause them to sink when placed on the water. Depending on the material used in the manufacturing process, the invention, with one or more attachments, only weighs 2 to 3 pounds. Although the current art allows for debris to be removed from greater distances than the invention 8, wind and water circulation generated by the pool filtration system cause the debris to drift and concentrate along one side of the pool. The shorter length of the pole 10 combined with its light weight allows the user to easily drag the screen 70 over the water surface and trap the floating debris and leaves. Because all of the attachments offered with this invention 8 which are connected to the end of the pole 10 use the same connector 16, the invention 8 can quickly and easily be converted from one type of maintenance device to another without changing poles 10 or having to purchase and store numerous single function devices.

While what has been described herein presents a preferred embodiment of the invention, as well as a few alternative embodiments, it will be understood by those skilled in the art that numerous changes may be made without departing from the spirit and scope of the invention.

The invention claimed is:

1. A pool maintenance device for a pool, the pool having a water pump with filter and a skimmer chamber with a cover and the skimmer chamber has a basket therein that is used for removing debris floating on the surface of the pool before it passes through the filter, and water chemical test strips are used to measure chemical properties of the water in the pool, the pool maintenance device comprising:

(a) a rigid adjustable length pole, with a top and bottom end, which can be shortened for ease of storage or lengthened to be lowered to various depths into water in the pool;

(b) one or more retaining clips that can be connected to the pole to simultaneously attach a water sampling bottle, a thermometer, and water chemical test strips against an exterior of the pole;

(c) a water depth indicator on a side of the pole to indicate when the pole has been lowered to a depth of 18 inches into the water of the pool;

(d) a removable water sampling bottle with a tapered neck at a mouth of the bottle, wherein a tapered opening of the mouth has a smaller diameter than the diameter of the body of the bottle; and the bottle further has a leak proof cap, the water sampling bottle being connectable to the pole using one of the retaining clips;

(e) a first attachment connected to the bottom end of the pole, the first attachment consisting of (i) an extracting tab with a horizontal surface that is at a right angle to the pole for removing a pool skimmer cover and (ii) a V-shaped extracting hook having a first end connected to the first attachment and a far end furthest from the first attachment, the extracting hook being located on an opposite side of the first attachment from the skimmer cover extracting tab; the extracting hook being used to lift and remove a skimmer basket, grab an automatic cleaner hose, and to snatch a pool thermometer line, wherein the V-shaped extracting hook has an interior surface proximal to the pole that includes frictional points consisting of serrations and/or protuberances, and an inverted flange situated at a distal end of the V-shaped extracting hook;

(g) a thermometer, the thermometer being connectable to the pole using one of the retaining clips and measuring the temperature of water in the pool;

(h) a first brush attachment with a swiveling head that is attachable to the bottom end of the pole and is used for scrubbing the sides and bottom of the pool;

(i) a gripping attachment that is attachable to the bottom end of the pole, the gripping attachment device having multiple elongated flexible fingers which operate as tension springs to grasp and hold onto items that are to be placed in or removed from the pool using the gripping attachment;

(j) a leaf and debris screen attachment that is attachable to the bottom end of the pole and is used for removing leaves and debris floating on the surface of the pool; and (k) an ultraviolet (UV) light inhibitor material placed on each of the pole, pole handle, retaining clips, the first attachment, water sample bottle, thermometer, brush attachment, gripping attachment, and the leaf and debris screen attachment to protect against sunlight degradation;

wherein each of the first attachment, the first brush attachment, the gripping attachment, and the leaf and debris screen attachment comes in contact with the bottom end of the pole via a protruding band, having a diameter larger than an outside diameter of the pole, and the protruding band prevents the retaining clips from sliding off the bottom end of the pole.

2. The pool maintenance device for a pool of claim 1 wherein the brush attachment may be attached anywhere along the length of the pole with the retaining clips.

3. The pool maintenance device for a pool of claim 1 wherein the first brush attachment has an elbow joint for positioning the first brush attachment outwardly and away from the bottom of the pole.

4. The pool maintenance device for a pool of claim 3 wherein said brush attachment elbow joint comprises a swivel fitting which can either lock the brush at a fixed angle with respect to an axis of the pole or can allow the brush to freely pivot to adapt to the contour of the sides and bottom of the pool.

* * * * *